United States Patent [19]

Cattaneo et al.

[11] Patent Number: 4,470,285

[45] Date of Patent: Sep. 11, 1984

[54] BILLET CENTERING AND CONTROL GUIDE FOR THE ENTRY GUIDE OF A PRESS-PIERCING MILL

[75] Inventors: Filippo Cattaneo, Milan; Edgardo Gnecchi, Sesto S. Giovanni, both of Italy

[73] Assignee: Innse Innocenti Santeustacchio, S.p.A., Brescia, Italy

[21] Appl. No.: 466,024

[22] Filed: Feb. 14, 1983

[30] Foreign Application Priority Data

Feb. 15, 1982 [IT] Italy ..... 19660 A/82

[51] Int. Cl.[3] ..... B21B 39/16

[52] U.S. Cl. ..... 72/251; 72/209; 72/428

[58] Field of Search ..... 72/209, 250, 251, 428; 198/484, 860; 308/3.9; 164/448

[56] References Cited

U.S. PATENT DOCUMENTS

| | | | |
|---|---|---|---|
| 2,033,649 | 3/1936 | Rendleman et al. | 72/251 |
| 3,348,399 | 10/1967 | Prieur | 72/209 |
| 4,006,618 | 2/1977 | Yanagimoto et al. | 72/251 |
| 4,196,942 | 4/1980 | Calmes et al. | 72/250 |

*Primary Examiner*—Lowell A. Larson

*Attorney, Agent, or Firm*—Fleit, Jacobson, Cohn & Price

[57] ABSTRACT

A billet centering and control guide for an entry guide for a PPM, which is of the rectilinear-tunnel type and is formed by two L-shaped portions which are hinged together about an axis parallel to the axis of the guide. The control guide can be opened essentially like a valve to allow the removal of a billet which may be trapped therein.

1 Claim, 5 Drawing Figures

BILLET CENTERING AND CONTROL GUIDE FOR THE ENTRY GUIDE OF A PRESS-PIERCING MILL

The present invention relates to a guide for controlling and centering billets for their subsequent axial insertion into an entry guide of a press-piercing mill.

A press-piercing mill, indicated below solely by the initials PPM, is a machine used to convert a square billet into an axially-pierced, round, intermediate blank. A PPM generally includes two rolls defining a circular gorge, a piercing tool carried by a mandrel extending along the rolling axis from the exit side of the PPM, and a hydraulic or mechanical pusher for forcing a billet between the rolls against the piercing tool.

A necessary condition for making cylindrical intermediate blanks which are pierced exactly along their axes is that the corresponding billets must be supported so that they are properly centered on the rolling and piercing axis from the moment they enter the passage between the rolls to the moment they leave this passage. In order to satisfy this need, PPMs are provided with entry and exit guides of suitable structure and dimensions.

An entry guide is generally in the form of a rectilinear tunnel having a cross-section which matches that of the billet to be pierced, the tunnel being defined, for example, by linear members or a plurality of rollers.

A billet coming from a continuous casting plant is conveyed towards the PPM on suitable roller tracks and is stopped laterally of the entry guide, into which it must then be inserted axially. Account being taken of the structural and dimensional characteristics of an entry guide, whether it is of the linear or roller type, the billet must be supported and guided in exact axial alignment with the entry guide of the PPM, for the insertion to be carried out in such a way as to avoid misalignments, seizures, jamming, and other similar snags which could cause a prolonged stoppage of the machine. In order to satisfy this requirement, a so-called billet centering and control guide is used, which is located immediately upstream of, and in axial aignment with, the entry guide of the PPM. The centering and control guide is also constituted basically by a rectilinear tunnel with a cross-section which matches the cross-section of the billet, a tunnel which is usually defined by a plurality of idle rollers.

Furthermore, on the side at which the billets arrive from the continuous casting plant, such a centering and control guide has a displaceable vertical wall so as to be accessible longitudinally to allow the lateral loading of a billet. After the loading of the billet, the displaceable wall is returned to its initial position and the billet may be pushed into the entry guide towards the rolls of the PPM.

With regard to billet centering and control guides of the aforesaid type, there is the following technical drawback. Due to accidental closure of the rolls during lateral loading, and particularly during the subsequent pushing through the control guide and then the entry guide of the PPM, one or more parts of a billet may bulge or undergo other similar deformations as a result, for example, of the fact that it is at a temperature of about 1250° to 1300° C. Consequently, the billet may jam in the control guide from which it can no longer be removed because it cannot be grasped through the open side of the guide. Thus, the control guide must be removed and replaced after stoppage of the PPM.

The technical problem behind this invention is the overcoming of this drawback, and this problem is solved according to the invention by a billet centering and control guide of the rectilinear-tunnel type, which has a cross-section matching the cross-section of a billet and is of predetermined length, characterised in that it comprises:

a first supporting structure of L-shaped cross-section which is hinged longitudinally at its outer corner to a pin carried by a base;

a second support structure of L-shaped cross-section which is hinged longitudinally along the free side of one of its limbs about a pin carried longitudinally by the first structure on the free side of one of its limbs;

at least one hydraulic cylinder supported by the first structure for displaying the second structure angularly about the axis of its hinge from a closed position, in which it defines a rectilinear tunnel with the first structure, to a second open position in which the tunnel is accessible laterally for a billet, and at least one hydraulic cylinder for angularly displacing the first support structure about its hinge on the base from an operative position in which the first structure rests on the base to a second out-of-line position in which the first support structure is supported laterally of the base.

The main advantage of the billet centering and control guide of the invention is basically the fact that the guide allows a billet which may be trapped therein to be grasped by conventional means and hence removed. Indeed, should this snag occur, the entire control guide can be turned over laterally of the base and, in this position, can then be opened, in the sense that the two L-shaped structures forming it can be opened upwardly away from each other, with an essentially valve-like opening. After such opening, it is easy to grasp the billet and remove it, and then return the control guide to its operative position on the base.

Further characteristics and advantages of the invention will become clearer from the following detailed description of one embodiment of a billet centering and control guide according to the invention, given by way of non-limiting example, with reference to the appended drawings, in which.

Figure 1:
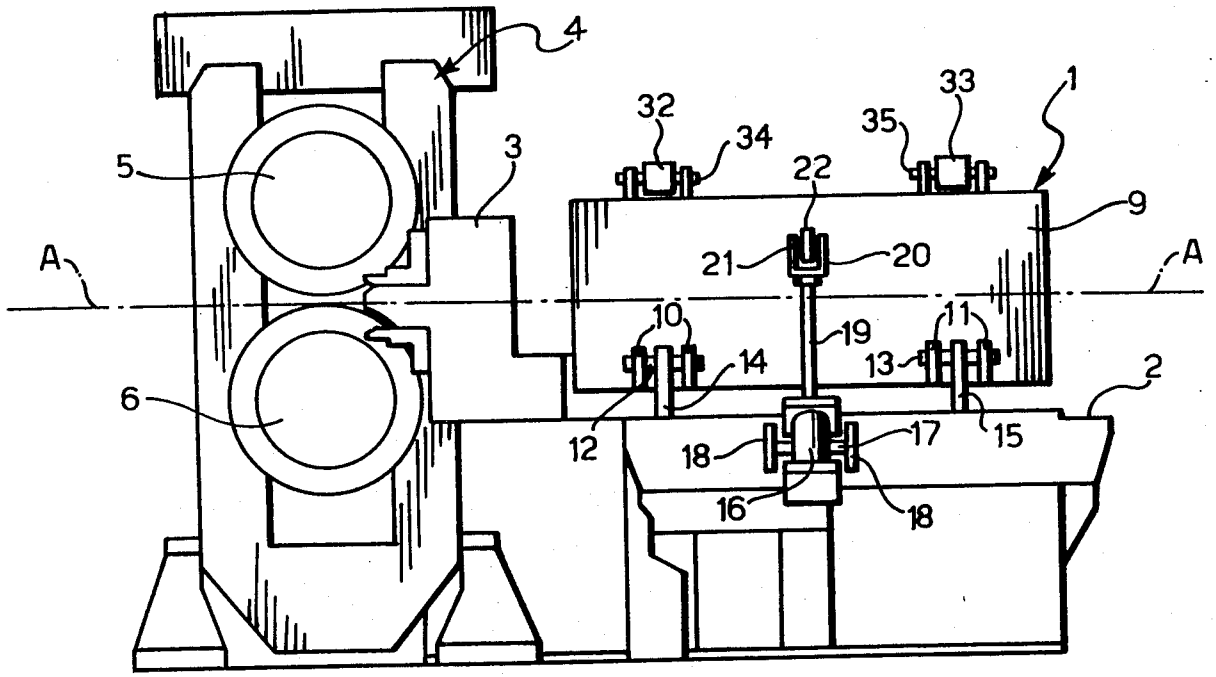
FIG. 1 is a schematic side view of a billet centering and control guide according to the invention aligned with an entry guide for a PPM.

With reference to FIG. 1, a billet centering and control guide, generally indicated 1, is supported in a conventional manner from a base 2 and is located immediately upstream of, and in axial alignment with, an entry guide 3 of a PPM 4. The entry guide 3, of which only the outline is shown schematically in FIG. 1, is preferably a linear-type guide but may also be a roller-type guide. The rolls 5, 6 of the PPM and its rolling and piercing axis A, which coincides with the longitudinal axis of both the entry guide and the billet centering and control guide 1, are shown schematically.

The control guide 1 includes a support structure 7 having an L-shaped cross-section with suitably dimensioned and reinforced limbs 8, 9.

The support structure 7 is provided at the outer corner formed by the limbs 8, 9 with two pairs of lugs, front lugs 10 and rear lugs 11, which are identical and are mounted rotatably on respective coaxial pins 12, 13 which are horizontal and parallel to the rolling axis A.

The pins 12, 13 are supported by right-angled supports 14, 15 fixed to the base 2 in positions laterally thereof. The pins 12, 13 can be withdrawn from the respective supports and the lugs 10, 11 of the structure 7 to allow the structure to be removed from the base and the rolling line, when required.

Figure 4:
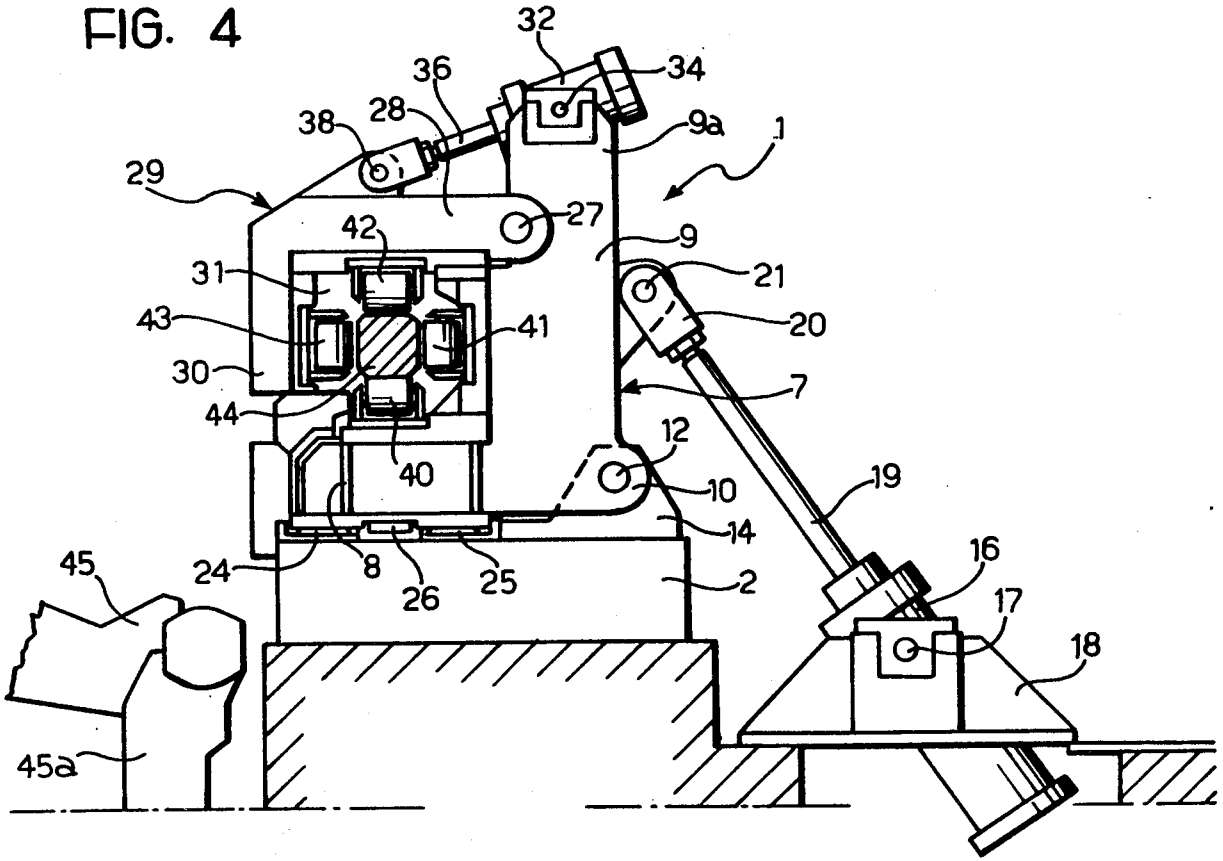
FIG. 4 is a front view of the guide of FIG. 2 in the operative condition of controlling and guiding the billet towards a PPM.
Figure 5:
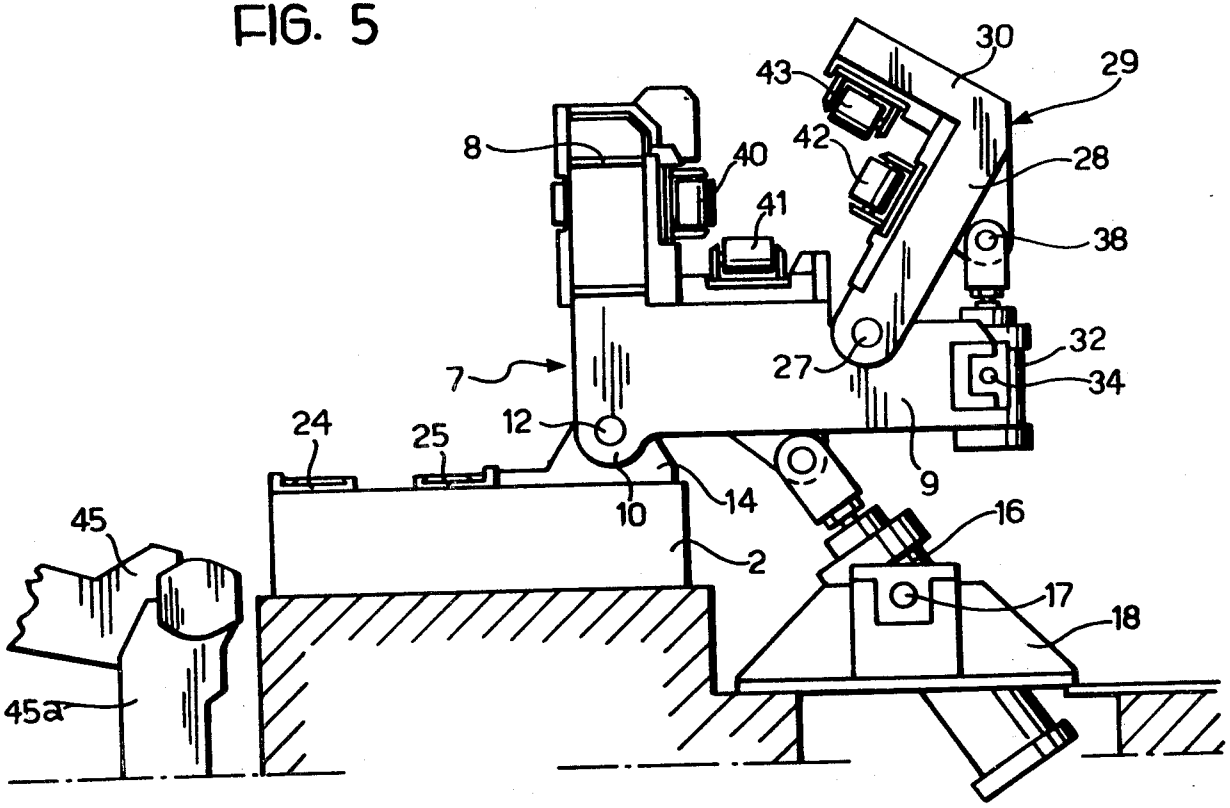
FIG. 5 shows the guide of the preceding Figures in the out-of-line condition for removing a jammed billet therefrom.

The structure 7 is displaceable angularly about the axis of the pins 12, 13 from a position in which it is in alignment with the entry stand 3 (FIGS. 2 and 4) to a position in which it is turned over laterally relative to the base 2 (FIG. 5).

Preferably, in order to effect these angular displacements, a hydraulic cylinder 6 is used and is mounted rotatably on a horizontal pin 17 which has its axis parallel to the rolling axis and is carried by a support 18 fixed to the floor laterally of the base 2. The rod 19 of the hydraulic cylinder has its free end 20 mounted rotatably on a horizontal pin 21 whose axis is parallel to the rolling axis A and is carried by a support lug 22 fixed to the wall 9 of the support structure 7. The pin 21 can be withdrawn to allow the structure to be removed from the base 2, when required.

When the structure 7 is aligned with the entry guide 3, the limb 8 of the structure rests on gibs 24, 25 carried by the base 2 and extending parallel to the rolling axis A; these gibs are spaced from a locator 26 dimensioned for use in centering the limb 8 on the base 2.

A pin 27 is supported in a conventional manner (not shown) by the limb 9 of the structure 7 close to the upper end 9*a* thereof. On this pin 27 is rotatably mounted the end of the limb 28 of a second structure 29 having an L-shaped cross-section, the other limb 30 of which extends towards the limb 8 of the support structure 7.

Figure 3:
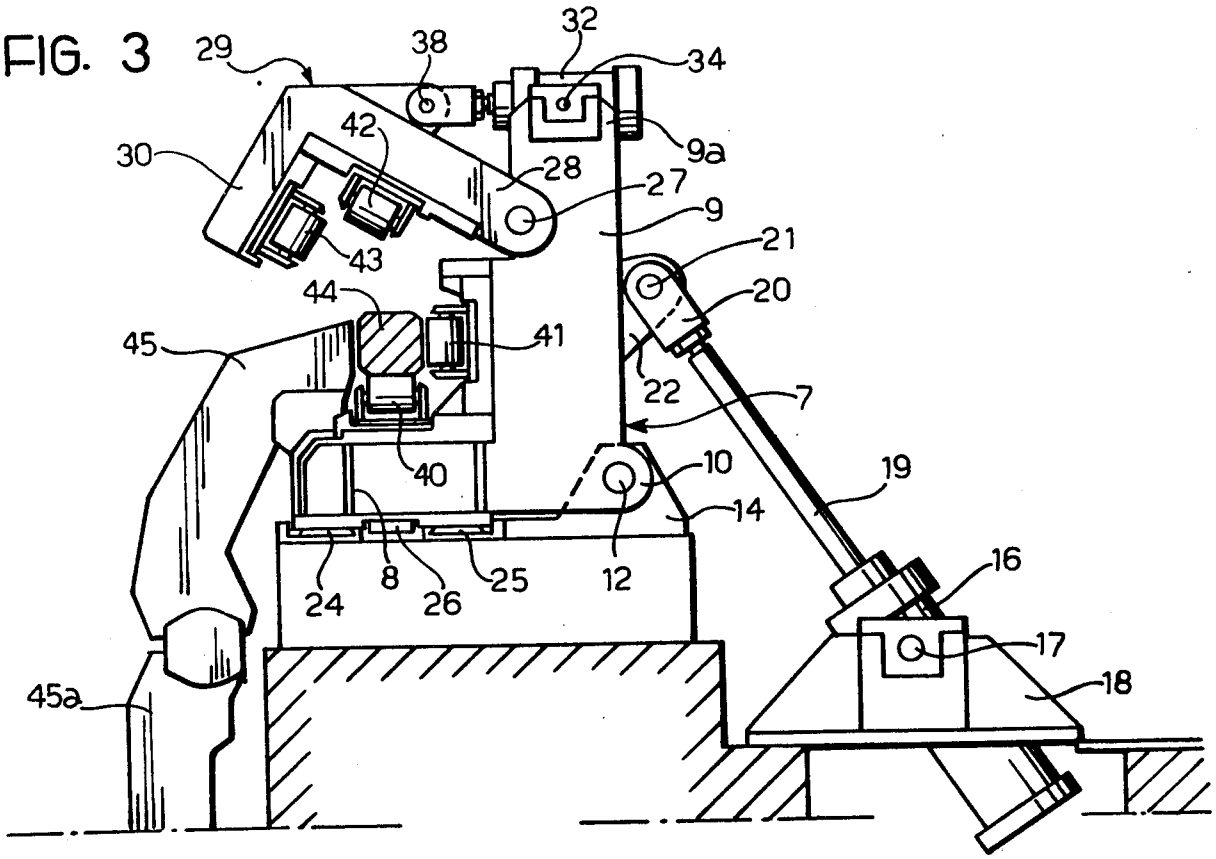
FIG. 3 is a front view on an enlarged scale of the billet centering and control guide of FIG. 1 in the billet receiving stage.

This structure 29 is displaceable angularly about the axis of the pin 27 from a closed position (FIG. 4), in which it defines an essentially tunnel-shaped space 31 having preferably a square cross-section, to an open position shown in FIGS. 3 and 5.

To advantage, two hydraulic cylinders 32, 33 are used for these angular displacements, the cylinders being rotatably mounted on respective pins 34, 35 supported in a conventional manner by the limb 9 of the structure 7 and extending parallel to the pin 27 mentioned above. The rods 36, 37 of the hydraulic cylinders have their respective ends rotatably mounted on pins 38, 39 supported conventionally by the limb 28 of the structure 29 and extending parallel to the pin 27.

The limbs 8, 9, 28, 30 of the structure 7 and the structure 29 are provided with corresponding pluralities of rollers 40, 41, 42, 43 on their respective walls which face inwardly of the tunnel 31 mentioned above. These pluralities of rollers, which are idle, are so sized and positioned as to define a passage having a cross-section which matches the cross-section of a billet 44 which the rollers are to support and guide in a centered position on the rolling axis A.

The operation of the billet centering and control guide described above is as follows.

Figure 2:
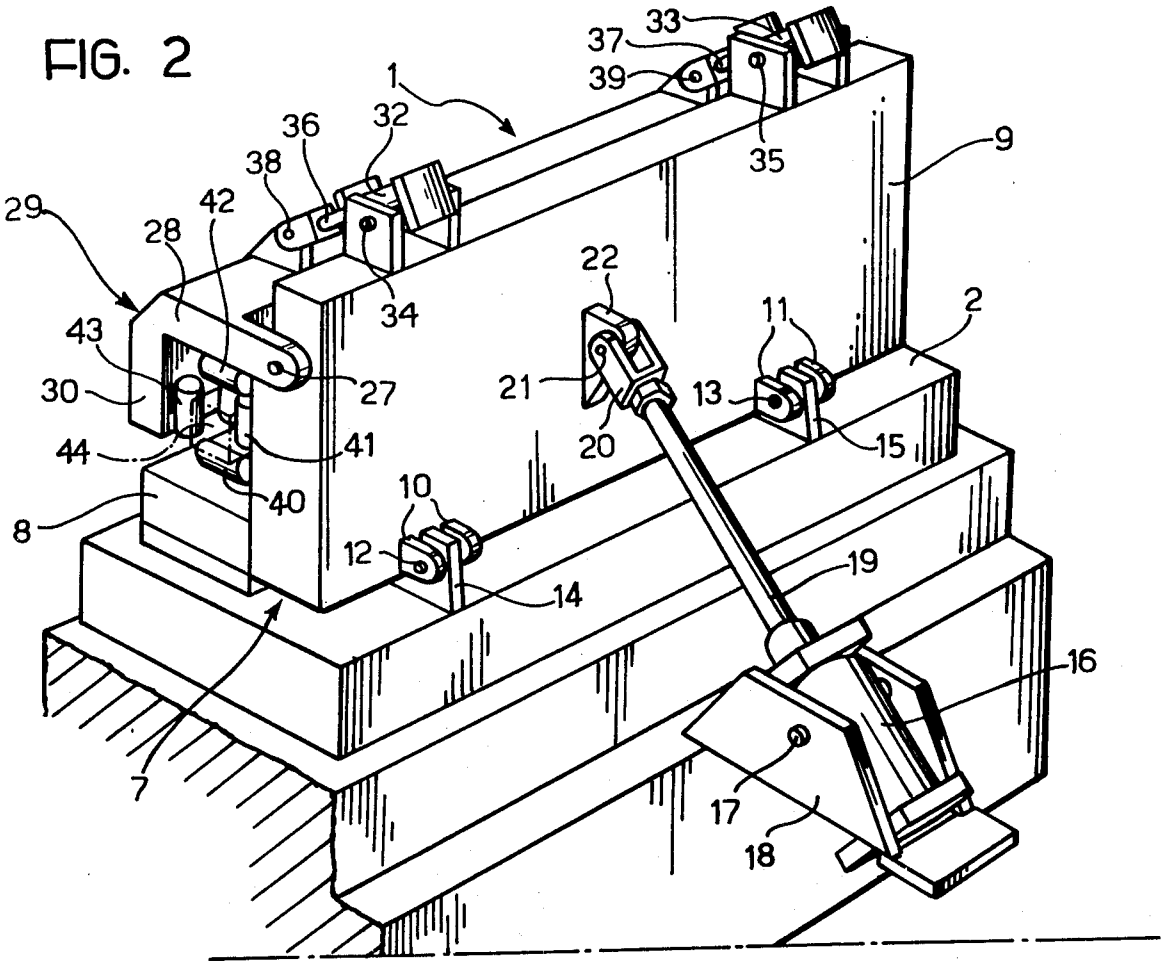
FIG. 2 is a schematic perspective view of a billet centering and control guide according to the invention.

In an initial condition, the control guide is in the position illustrated in FIG. 2, in which the structure 7 is firmly held on the base 2 by the hydraulic cylinder 16. The structure 29 is held in the open position, defined above, by the cylinders 32, 33, thus rendering the tunnel 131 accessible from the side. A billet 44 has been loaded by means of conventional transfer members, indicated schematically 45, 45*a*, onto the plurality of rollers 40 and 41 of the limbs 8, 9 of the support structure 7 and, in this position, the billet is aligned with the axis of the entry guide 3 and consequently with the rolling axis A.

By actuation of the hydraulic cylinders 32, 33, the structure 29 is now returned to the closed position in which the plurality of rollers 42, 43 come into rolling contact with the billet 44, ensuring the support, control and centered positioning thereof (FIG. 3). At this point, the billet may be pushed into the entry guide 3 and between the rolls 5, 6 of the PPM.

In order to remove a jammed billet 1 from the control guide, the hydraulic cylinder 16 is actuated to turn the entire guide about the axis of the pins 12, 13 so as to position the guide laterally of the base 2, as shown in FIG. 5. During this angular displacement the structure 29 is firmly maintained in its closed position by the cylinders 32, 33. When the control guide 1 is set in its new position, the cylinders 32, 33 open the structure 29, that is to say, they effect an angular displacement about the axis of the pin 27 until the open position is reached. In this condition, the control guide is open upwardly and the billet may be grasped from above by conventional means, unjammed, and lifted away from the guide itself. The guide may then be returned to the base 2 to receive a new billet.

It should be noted that, when it is required to replace the billet centering and control guide, to change its calibre, for example, it suffices to withdraw the pins 12, 13, 21 which retain the guide and remove the latter.

We claim:

1. A billet centering and control guide, for an inlet guide of a press piercing mill, which is of rectilinear-tunnel type with a cross-section matching the cross-section of a billet and is of predetermined length, wherein the improvement consists in the guide comprising:

a base carrying at least one hinge pin;

a first structure of L-shaped cross-section which is hinged longitudinally at its outer corner about said at least one pin carried by the base;

a hinge pin carried longitudinally at the free side of one of the limbs of said first L-shaped structure;

a second structure of L-shaped cross-section which is hinged longitudinally along the free side of one of its limbs about the hinge pin carried by the first structure;

at least one hydraulic cylinder supported by the first structure for displacing the second structure angularly from a closed position, in which it defines a rectilinear tunnel with the first structure to a second open position in which the tunnel is accessible laterally for a said billet, and at least one hydraulic cylinder for angularly displacing the first structure about its hinge on the base from a position in which it rests on the base to a position in which it is supported laterally of the base.

* * * * *